US005618066A

United States Patent [19]

Fu-Hsiang

[11] Patent Number: 5,618,066

[45] Date of Patent: Apr. 8, 1997

[54] AUTOMATIC LATCH DEVICE

[76] Inventor: Chen Fu-Hsiang, 47-14, Fan-po Street, Fan-po Village, Fu-Hsin Hsiang, Chang Hwa Hsien, Taiwan

[21] Appl. No.: 555,864

[22] Filed: Nov. 13, 1995

[51] Int. Cl.[6] ..... E05C 5/02

[52] U.S. Cl. ..... 292/62; 292/DIG. 66

[58] Field of Search ..... 292/62, DIG. 66, 292/60, 59, 57, 144

[56] References Cited

U.S. PATENT DOCUMENTS

| | | | |
|---|---|---|---|
| 3,999,790 | 12/1976 | Rogen | 292/DIG. 66 X |
| 4,505,501 | 3/1985 | Fuchs et al. | 292/62 |
| 4,539,929 | 9/1985 | Sestak et al. | 116/221 |
| 5,121,950 | 6/1992 | Davidian | 292/DIG. 66 X |
| 5,125,695 | 6/1992 | Hartwell | 292/62 |
| 5,380,053 | 11/1995 | Saino | 292/DIG. 66 X |
| 5,427,420 | 6/1995 | Moore | 292/DIG. 66 X |

*Primary Examiner*—Rodney M. Lindsey
*Assistant Examiner*—Monica E. Millner
*Attorney, Agent, or Firm*—Larson and Taylor

[57] ABSTRACT

A latch device includes a pin slidably engaged in a housing. The pin includes one end for engaging with a retainer so as to lock a door panel in place. A spring member is engaged between the pin and the housing and is made of shape memory alloy and is deformed to a shorter or longer length different from an original length so as to allow the pin to engage with the retainer. The spring member may be recovered to the original length so as to disengage the pin from the retainer when the spring member is heated such that the door panel may be opened automatically in a fire.

4 Claims, 6 Drawing Sheets

AUTOMATIC LATCH DEVICE

BACKGROUND OF THE INVENTION

1. Field of the Invention

The present invention relates to a latch device, and more particularly to an automatic latch device that may be opened automatically when the latch device is heated to a higher temperature.

2. Description of the Prior Art

A typical latch device is shown in FIG. 1 and comprises a retainer 91 secured to the frame and a housing 92 secured to the door panel, and comprises a latch pin 93 slidably engaged in the housing 92 and movable toward the retainer 91 for engaging with the retainer 91 so as to lock the door panel in place. The latch pin 93 may not be opened automatically in fire such that the fire fighters have to break the door panels for extinguishing the fire. Some buildings have the walls formed by fixed glass door panels which are solidly secured in place and which may not be opened, such that the fire fighters have to break the glass door panels for extinguishing the fire.

The present invention has arisen to mitigate and/or obviate the afore-described disadvantages of the conventional door latch devices.

SUMMARY OF THE INVENTION

The primary object of the present invention is to provide an automatic latch device which may be opened automatically when the latch device is heated to a higher temperature, so as to allow the door panel to be opened automatically, such that the fire fighters may easily enter into the house without breaking the door panels.

In accordance with one aspect of the invention, there is provided a latch device for locking a door panel, the latch device comprises a housing including a bulge formed therein so as to define a channel therein, a pin slidably engaged in the channel and including a first end and a second end, a retainer for engaging with the first end of the pin so as to lock the door panel, and a spring member engaged between the pin and the housing. The spring member is made of shape memory alloy and is deformed to a deformed length different from an original length, the spring member is recovered to the original length so as to disengage the first end of the pin from the retainer when the spring member is heated.

The bulge includes a flange extended therefrom, the pin includes a head formed in the second end thereof, the spring member is biased between the flange and the head of the pin, the spring member is shortened to a shorter length so as to allow the first end of the pin to engage with the retainer, and the first end of the pin is disengaged from the retainer when the spring member is lengthened to the original length and when the spring member is heated.

The bulge includes an end wall, the spring member includes a first end secured to the second end of the pin and includes a second end secured to the end wall, the spring member is lengthened to a longer length so as to allow the first end of the pin to engage with the retainer, and the first end of the pin is disengaged from the retainer when the spring member is shortened to the original length and when the spring member is heated.

The bulge includes a middle portion having a cutoff portion formed therein, the pin includes a middle portion having a knob secured thereto for moving the pin along the channel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
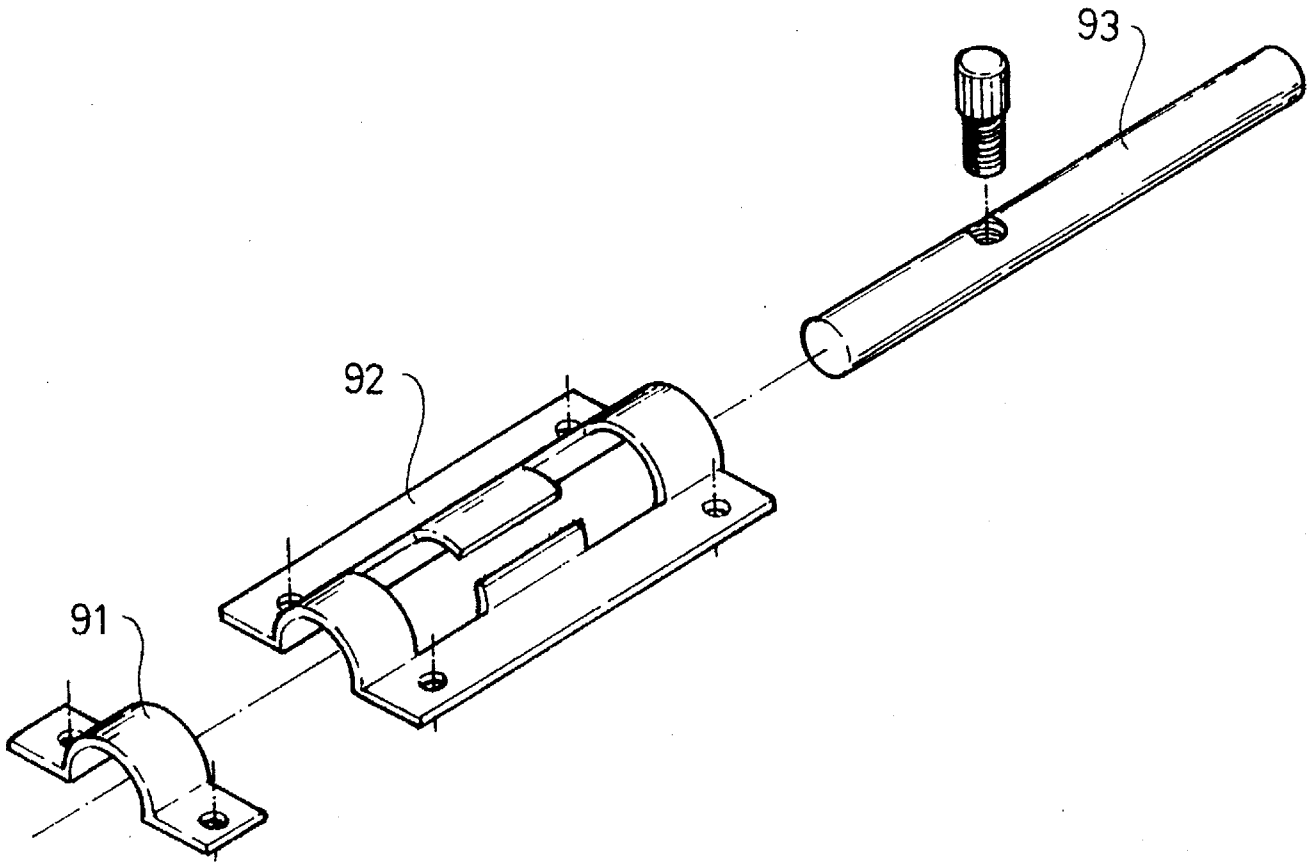
FIG. 1 (PRIOR ART)
FIG. 1 is an exploded view of a typical latch device.

Before describing the latch device in accordance with the present invention, a shape memory alloy is first introduced and will be used in the latch device. A typical metal material may have a permanent deformation after suffering an external force which exceeds over the yielding strength of the typical metal materials. For some special alloy materials, after treatment of accommodation of martensite or of stress-induced martensitic transformation, the alloy materials may have a limited deformation when suffering an external force. When the deformed alloy materials is heated to the temperature ranges of the parent phase, the deformed alloy materials may be recovered or restored to the original shape. This is called the shape memory effect, and the alloy materials that include shape memory effect are called the shape memory alloy. For example, a spring may be made with the shape memory alloy and may be deformed by an external force so as to lengthen or the shorten the length thereof. The spring may be recovered to the original shape when heated.

Referring to the drawings, and initially to FIGS. 2 to 5, a latch device comprises a retainer 1 including two holes 11 for engaging with fastening screws which may secure the retainer 1 to the wall member 90. The retainer 1 includes an engaging hole 12 formed therein. A housing 2 includes a number of holes 21 for engaging with fastening screws which may secure the housing 2 to the window or door panel 91. The housing 2 includes a semi-cylindrical bulge 22 formed thereon so as to define a channel 221 therein for slidably engaging with a pin 3. The bulge 22 includes a cut-off middle portion 23 and includes a flange 222 extended radially inward therefrom so as to define an opening 24 therein. The pin 3 is slidably engaged in the channel 221 and the opening 24 and includes a screw hole 33 formed in the middle portion for engaging with a knob 34 which may move the pin 3 along the channel 221. The pin 3 includes a head 31 formed in one end and includes the other end for engaging with the engaging hole 12 of the retainer 11 so as to lock the door panel 91 in place. The latch device further includes a spring 32 biased between the flange 222 and the head 31 of the pin 3.

Figure 2:
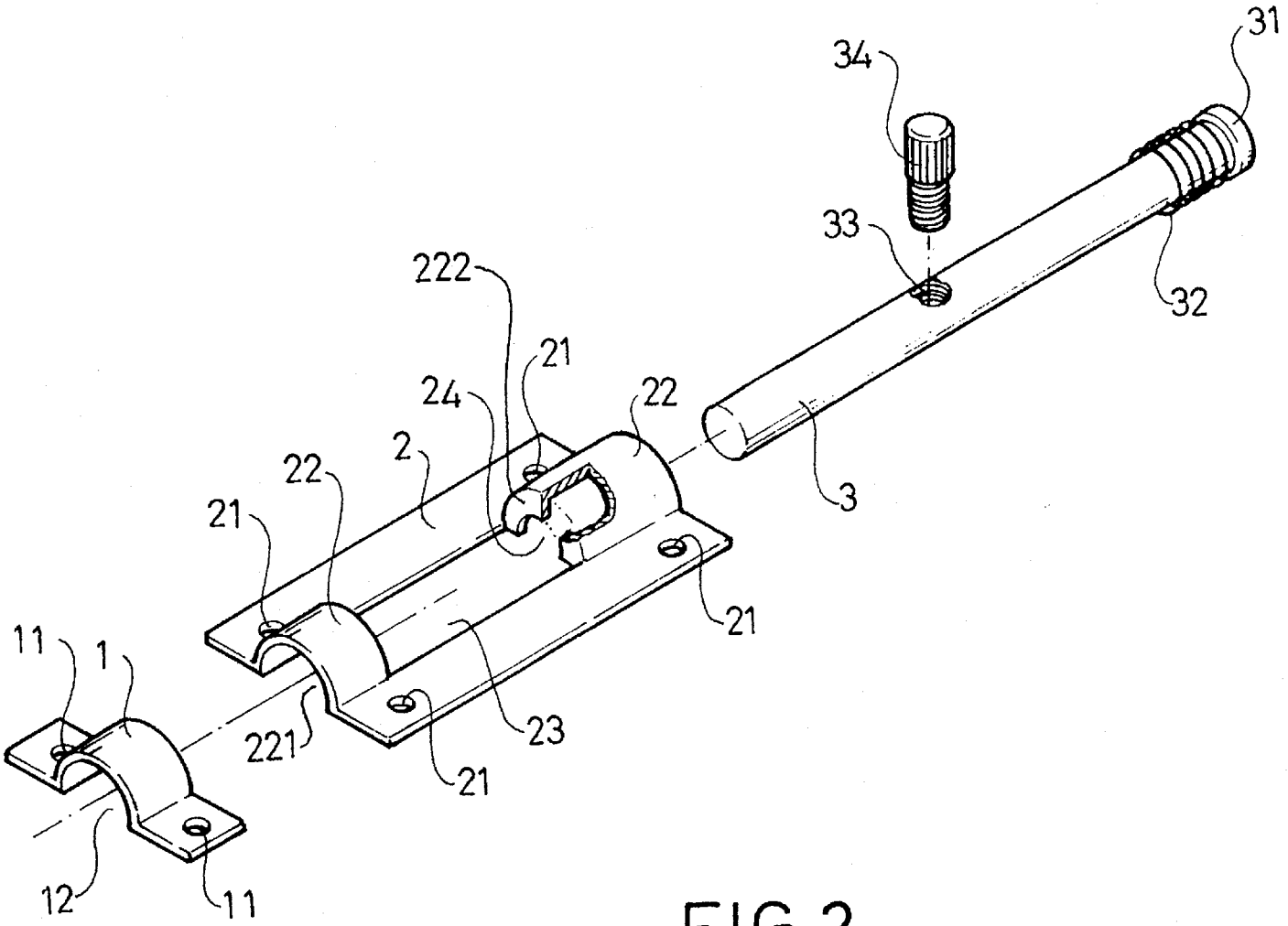
FIG. 2 is an exploded view of a latch device in accordance with the present invention.
Figure 3:
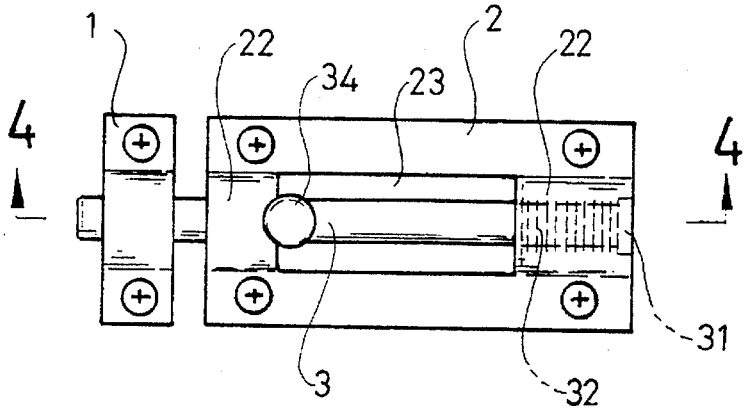
FIG. 3 is a top view of the latch device.
Figure 4:
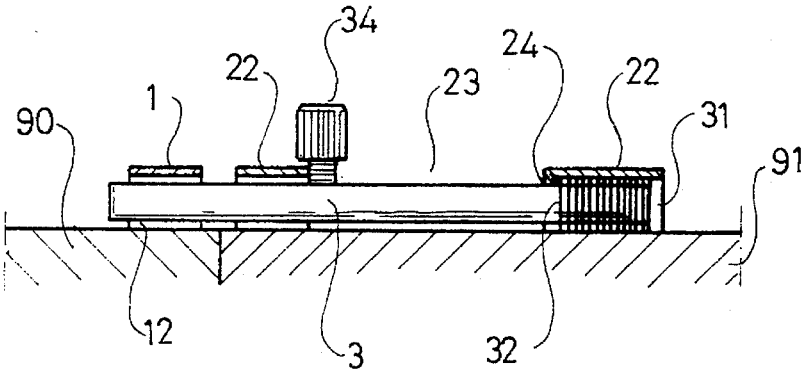
FIGS. 4 and 5 are cross sectional views taken along lines 4—4 of FIG. 3.
Figure 5:
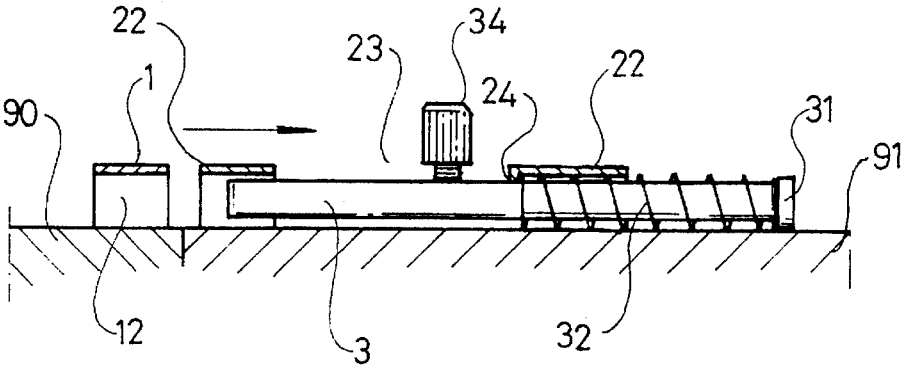

It is to be noted that the spring 32 is made of shape memory alloy and is shortened to a shorter length by an external force, as shown in FIGS. 2 to 4. When the latch device is heated in a fire, the spring 32 will be recovered to the original longer length as shown in FIG. 5, such that the pin 3 can be disengaged from the retainer 1 and such that the door panel 91 can be opened without moving the knob 34 of the latch device.

Referring next to FIGS. 6 to 9, illustrated is another embodiment of the latch device which also comprises a retainer 1 including two holes 11 for engaging with fastening screws which may secure the retainer 1 to the wall member 90. The retainer 1 includes an engaging hole 12 formed therein. A housing 4 includes a number of holes 41 for engaging with fastening screws which may secure the housing 4 to the window or door panel 91. The housing 4 includes a semi-cylindrical bulge 42 formed thereon so as to define a channel 421 therein for slidably engaging with a pin 5. The bulge 42 includes a cut-off middle portion 43 and includes an end wall 422. The pin 5 is slidably engaged in the channel 421 and includes a screw hole 53 formed in the middle portion for engaging with a knob 54 which may move the pin 5 along the channel 421. The pin 5 includes one end for engaging with the engaging hole 12 of the retainer 11 so as to lock the door panel 91 in place. The latch device further includes a spring 52 having one end secured to the pin 5 and having the other end secured to the end wall 422 by a screw 45 and a nut 44.

Figure 6:
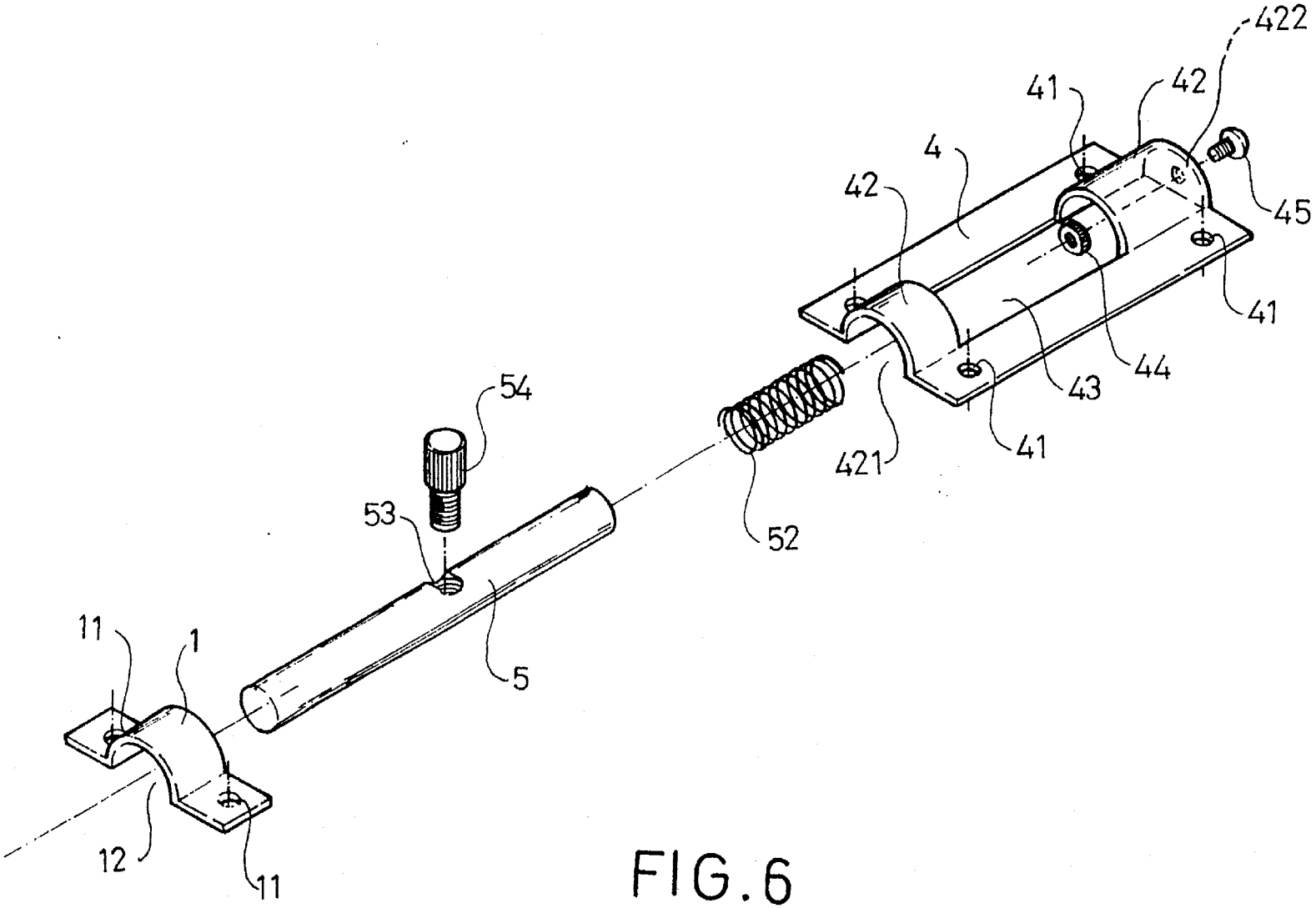
FIG. 6 is an exploded view illustrating another embodiment of the latch device in accordance with the present invention.
Figure 7:
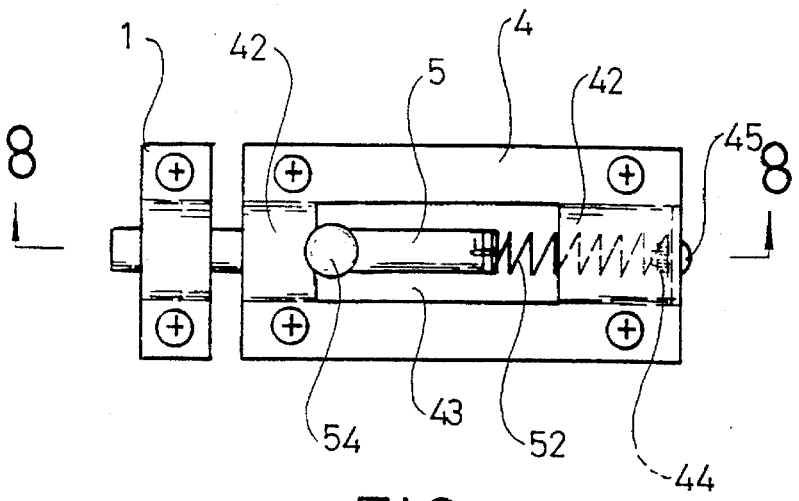
FIG. 7 is a top view of the latch device as shown in FIG. 6.
Figure 8:
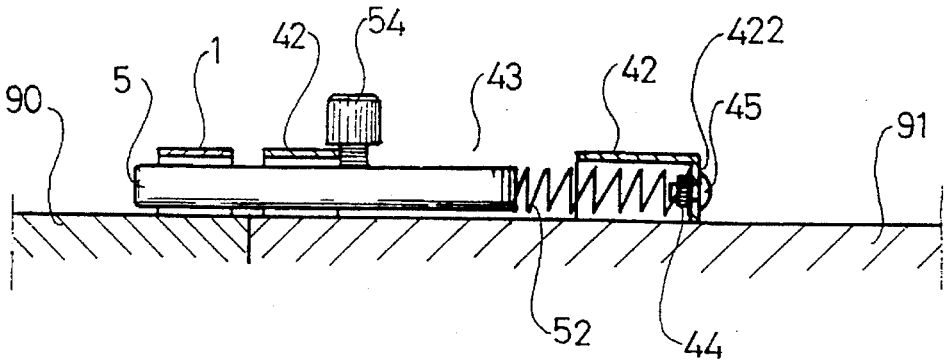
FIGS. 8 and 9 are cross sectional views taken along lines 8—8 of FIG. 7.
Figure 9:
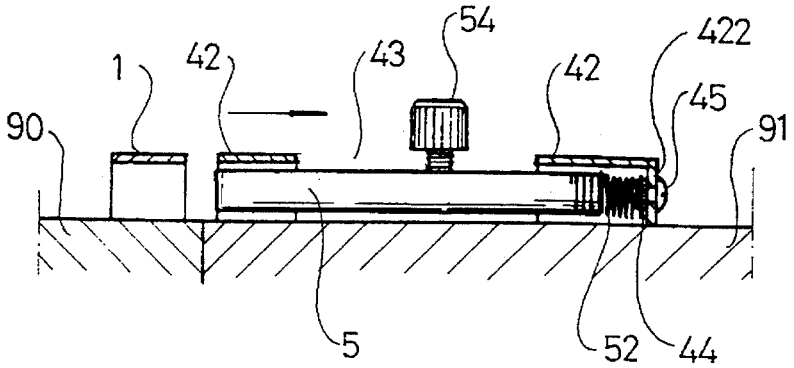
Figure 11:
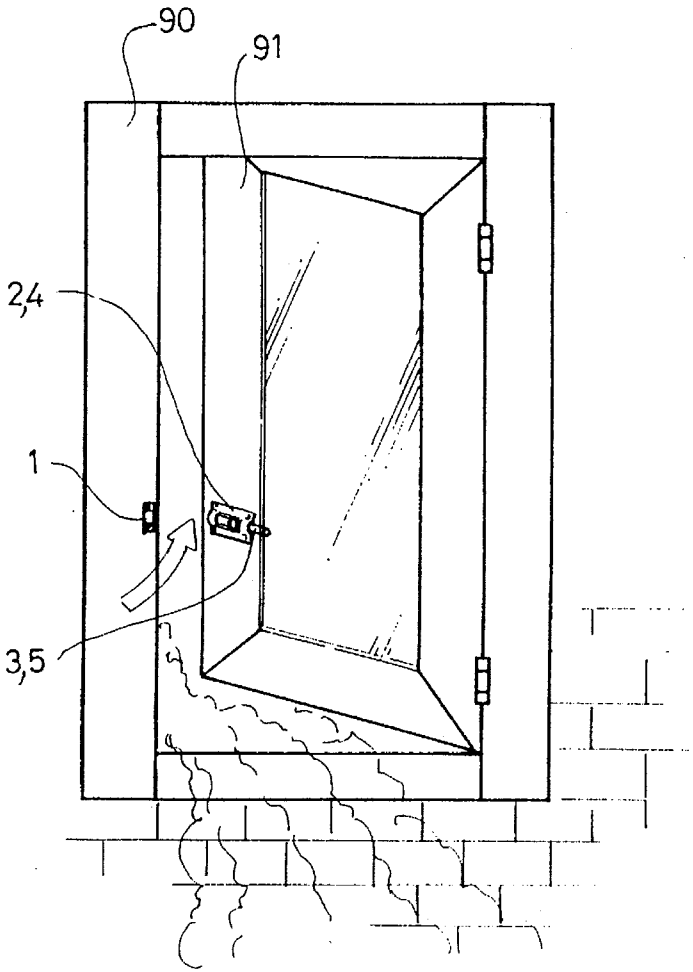
FIGS. 10, 11 are schematic views illustrating the application of the latch device.

It is to be noted that the spring 52 is made of shape memory alloy and is lengthened to a longer length by an external force, as shown in FIGS. 6 to 8. When the latch device is heated in a fire, the spring 52 will be recovered to the original shorter length as shown in FIG. 9, such that the pin 5 can be disengaged from the retainer 1 and such that the door panel 91 can be opened without moving the knob 54 of the latch device.

Figure 10:
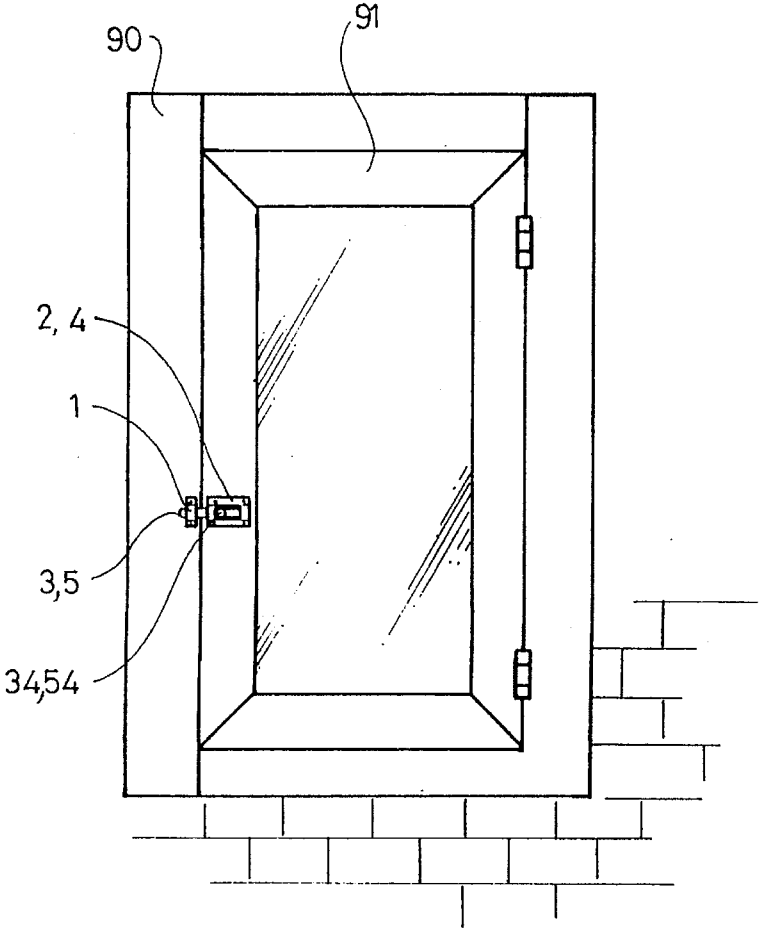

Referring next to FIG. 10, the retainer 1 of the latch device may be secured to the frame or the wall 90 and the housing 2, 4 may be secured to the door panel 91. When the pin 3, 5 is automatically disengaged from the retainer 1 in a fire, the door panel 91 may be opened automatically by the heated and expanded air in the room such that the fire fighters may easily enter into the building for extinguishing the fire.

Accordingly, the latch device in accordance with the present invention includes a spring which is made of shape memory alloy and which has a shortened or lengthened length so as to allow the latch device to be opened automatically when the spring is heated to a higher temperature.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A latch device for locking a door panel, said latch device comprising:

a housing including a bulge formed therein so as to define a channel therein, a pin slidably engaged in said channel and including a first end and a second end, a retainer for engaging with said first end of said pin so as to lock the door panel, and a spring member engaged between said pin and said housing, said spring member being made of shape memory alloy and being deformed to a deformed length different from an original length, said spring member being recovered to said original length so as to disengage said first end of said pin from said retainer when said spring member is heated.

2. A latch device according to claim 1, wherein said bulge includes a flange extended therefrom, said pin includes a head formed in said second end thereof, said spring member is biased between said flange and said head of said pin, said spring member is shortened to a shorter length so as to allow said first end of said pin to engage with said retainer, and said first end of said pin is disengaged from said retainer when said spring member is lengthened to said original length and when said spring member is heated.

3. A latch device according to claim 1, wherein said bulge includes an end wall, said spring member includes a first end secured to said second end of said pin and includes a second end secured to said end wall, said spring member is lengthened to a longer length so as to allow said first end of said pin to engage with said retainer, and said first end of said pin is disengaged from said retainer when said spring member is shortened to said original length and when said spring member is heated.

4. A latch device according to claim 1, wherein said bulge includes a middle portion having a cut-off portion formed therein, said pin includes a middle portion having a knob secured thereto for moving said pin along said channel.

* * * * *